United States Patent [19]

Heinz

[11] Patent Number: 4,546,694

[45] Date of Patent: Oct. 15, 1985

[54] BLOWER UNIT FOR AIR-CONDITIONING PLANT

[75] Inventor: Wieland Heinz, Waldenburg, Fed. Rep. of Germany

[73] Assignee: Wilhelm Gebhardt GmbH, Fed. Rep. of Germany

[21] Appl. No.: 651,056

[22] Filed: Sep. 17, 1984

Related U.S. Application Data

[62] Division of Ser. No. 442,272, Nov. 17, 1982, Pat. No. 4,493,341.

[30] Foreign Application Priority Data

Dec. 7, 1981 [DE] Fed. Rep. of Germany ..... 3148357

[51] Int. Cl.[4] ..... F24F 13/04

[52] U.S. Cl. ..... 98/34.6; 165/16

[58] Field of Search ..... 165/16; 236/13; 62/409; 98/33 A, 38 B, 38 D, 38 E, 38 F

[56] References Cited

U.S. PATENT DOCUMENTS

| | | | |
|---|---|---|---|
| 1,825,103 | 9/1931 | Stacey, Jr. | 137/875 X |
| 2,157,307 | 5/1939 | Savage | 98/38 F X |
| 2,234,633 | 3/1941 | Hoppe | 98/33 A X |
| 2,321,242 | 6/1943 | Ramsey | 62/409 X |
| 3,782,448 | 1/1974 | Clark | 165/16 |
| 4,134,542 | 1/1979 | Sugiura | 236/13 |
| 4,227,569 | 10/1980 | Wattin | 237/12.3 A X |
| 4,281,522 | 8/1981 | Bussjager | 62/409 |

*Primary Examiner*—William E. Tapolcai

*Attorney, Agent, or Firm*—Steven L. Permut; Malcolm L. Sutherland; Leon E. Redman

[57] ABSTRACT

A blower unit, designed for use for example with air-conditioning plant, has an outer housing with a first aspiration or inlet connection forming part of an aspiration duct for a primary volume flow, and a second aspiration connection forming part of an aspiration duct for a secondary volume flow. The outer housing furthermore has outlet or pressure connections joined up with the primary and with the secondary circuits for the supply of air thereto. In the housing two blower impellers are placed and the outer part of the housing has an adjustable unit which may be moved into different positions of adjustment so that the volume flows incoming at the outlet side of the blower impellers may be directed by different adjustments to the pressure (or outlet) connections as may be desired. The outer housing has two separate spaces in which the two blower impellers are placed which are fixed in an axial direction. Each such blower impeller has an air guiding housing. On the inlet side the one space is joined up with the first aspiration connection for the primary air current and the other space is joined up with the secondary aspiration connection for the secondary air current or flow. The automatic control unit has a control unit housing with two inlets joined up with the outlets of the two blowers, and with three outlet connectors, forming part of the primary circuit and the secondary circuit. For adjustment of the distribution of the volume flows or currents there are two adjustable valves, each designed for use for one of the outlets of the outer housing.

3 Claims, 2 Drawing Figures

BLOWER UNIT FOR AIR-CONDITIONING PLANT

Figure 1:
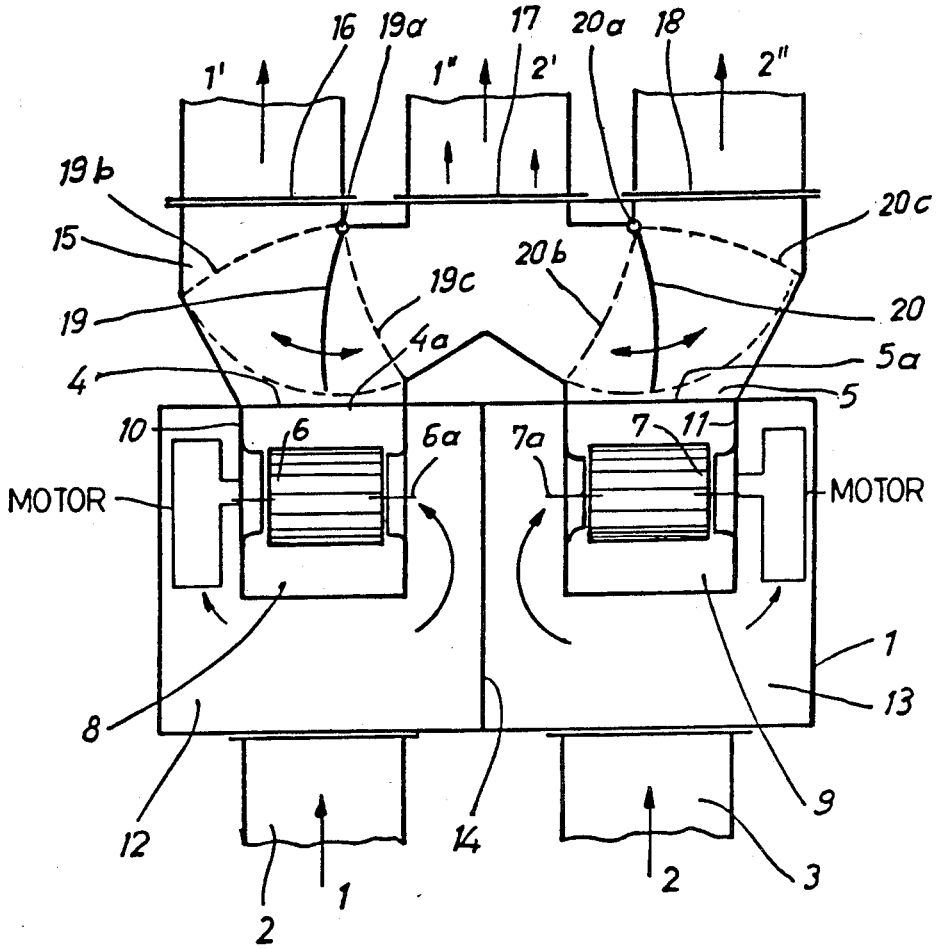

This is a division of application Ser. No. 442,272, filed Nov. 17, 1982, now U.S. Pat. No. 4,493,341.

BACKGROUND OF THE INVENTION

The present invention is with respect to a blower unit which may be used in air-conditioning plant and for other purposes. Such a blower unit may, for example, have an outer housing with a first inlet or aspiration connection forming part of an aspiration duct for a primary volume flow, and with a second aspiration connection forming part of an aspiration duct for a secondary volume flow, and with an outlet or pressure connection joined up with the return air duct of the primary circuit and a pressure or outlet connection forming part of the return air duct of the secondary circuit. Such a blower unit may furthermore have two motor-powered impellers which are supported by bearings and whose outlet connection has an distributor unit designed for adjustment between different positions and with whose help the incoming volume flows at the outlet side of the blower impeller may be switched, as may be desired, for distribution between the two pressure connections.

Such systems are known in the art and have been designed with the purpose of making for simpler installation of heating and air-conditioning plant and the like in a building, and furthermore for cutting down the amount of driving power needed. In such known units, however, the impellers have to be able to undergo adjustment axially in relation to the housing, for which reason a complex system for moving the impeller is needed. Furthermore, in this case, every adjustment gives a new ratio between the impeller breadth and the breadth of the housing, this having an effect on the efficiency characteristic so that great changes therein will be likely. Furthermore, in the case of this known plant, the use of drum-like impellers is not possible for aerodynamic reasons because, as will be clear, a drum-like impeller has to be used with a fixed design of housing if good aerodynamic properties are to be produced. Furthermore, in the case of such known plant, fans with aspiration openings on two sides are not possible.

GENERAL ACCOUNT OF THE INVENTION

One purpose of the invention is that of taking care of the shortcomings noted.

A further purpose of the invention is that of making such a better design or blower units of the sort coming into question here that, while said units may still be run the useful effects noted, they may be more simply produced and give a higher efficiency and furthermore are more simply run.

For effecting these and further purposes, as part of the invention, the outer housing of the blower unit is cut up into two separate spaces, in each of which there is one of the two blowers, each such blower being fixed in an axial direction and being made up of a blower impeller or wheel and an air guide housing, and on the inlet side the one space is joined up with the first aspiration or inlet connection for the primary air current and the other space is joined up with the second aspiration connection for the secondary air flow. Furthermore, the distributor unit has a distributor unit housing which, for its part, has two inlets joined up with the outlets of the two blowers, and has three outlet connectors, one forming part of a primary air circuit which leads to an air conditioning unit, a second forming part of a secondary air circuit leading to a room to be air conditioned, and a third exiting to the ambient atmosphere. For distribution of the primary and secondary air flows there are two valve parts, positioned for use with the outlets of the outer housing and which may undergo adjustment. In this respect the adjustment parts, for example, may take the form of turning doors, which may, in each case, be turned about an axis which is at a right angle to the axis of turning of the blower impeller. The adjustment parts may, however, be in the form of sliding doors for example, which may be moved at a right angle to the outflow direction.

Taking a general view, it will be seen that the outcome is a system of simple design, that is to say one which is simpler than known systems (which are otherwise generally like the present system of the invention) and which, for these reasons is able to be produced more simply and at a lower price, because the driving system of the turning valve doors, for example, may be made simple in design so that, because of this, the system is generally of high efficiency on operation. Furthermore, the useful effects of known plant designed on the same lines are not given up, namely inasfar as the costs for installing such a system as part of a heating or air-conditioning plant in large buildings are decreased. A further useful effect is the decrease in the amount of driving power needed.

The invention is furthermore with respect to an air-conditioning plant having a blower unit of the invention, the conditioning plant being characterized in that it has an air-conditioner, for example an air-conditioner without a fan, whose outlet is joined up with the aspiration connections of the outer housing, and has two inlets, of which one is joined up with a duct coming from the first outlet connector of the outer housing, whereas the other one is joined up with the outside atmosphere, and furthermore the room which is to be air-conditioned is joined up with the outer housing of the blower unit for taking up air from such housing. Furthermore, for example, the primary circuit may be made up of one circuit part having the outer housing of the blower unit and the air-conditioner as parts thereof, whereas the secondary circuit is placed for forming a connection between the room which is to be air-conditioned, the unit, and the outside atmosphere. The air-conditioning plant of the present invention is marked by a simple, trouble-free design and may be run economically.

LIST OF FIGURES AND DETAILED ACCOUNT OF WORKING EXAMPLE OF THE INVENTION

Further useful effects of the invention will be seen from the figures, in which

Figure 2:
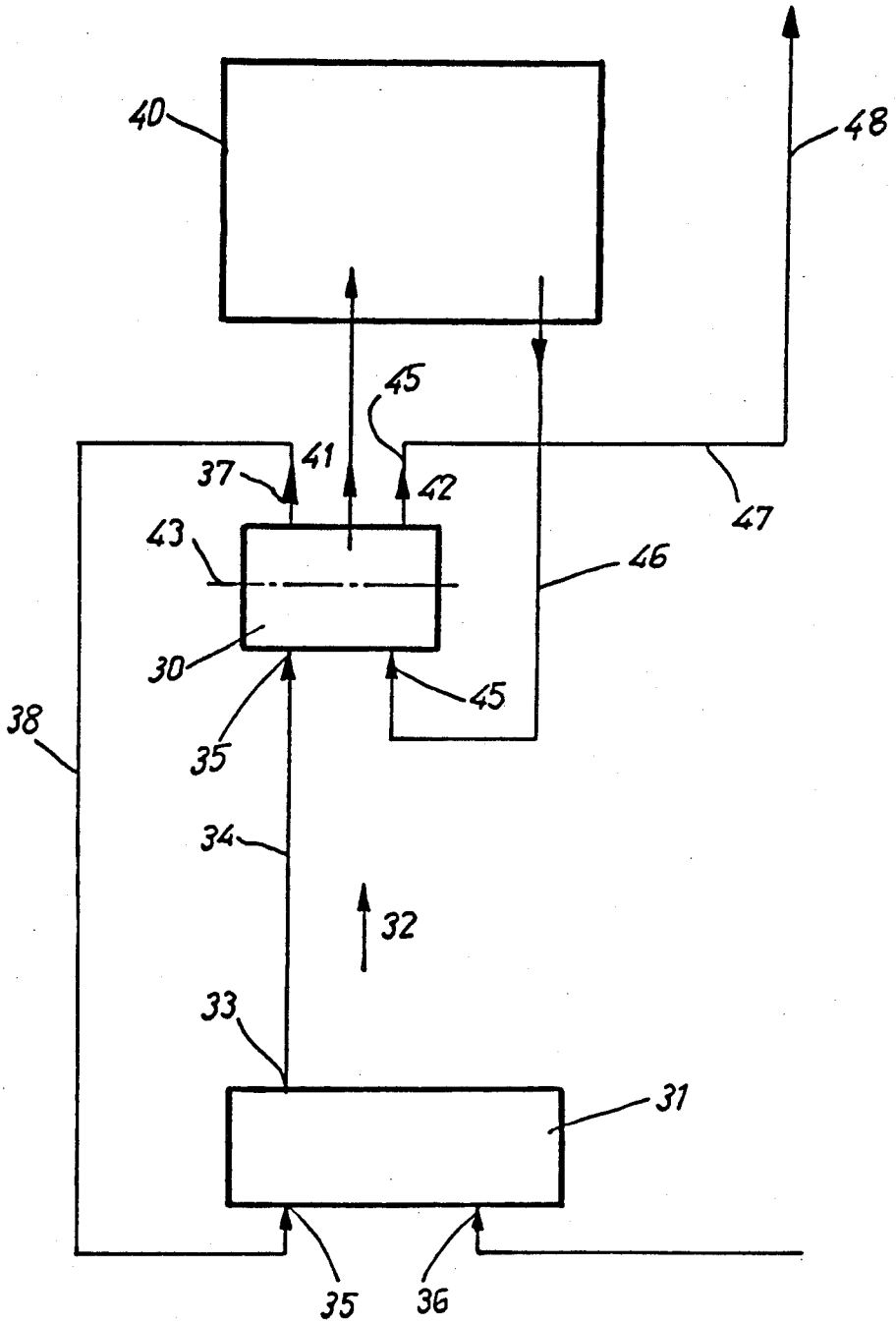

FIG. 1 is a diagrammatic, side view of a blower system of the present invention and FIG. 2 is a view of an air-conditioning plant having a blower unit of the type to be seen in FIG. 1, again in a diagrammatic view.

The blower of the present invention may be seen in FIG. 1 to have an outer housing 1 with a first aspiration or inlet connection 2 forming part of an aspiration duct for a primary volume flow, of which a more detailed account will be given. The outer housing 1 furthermore has a second inlet or aspiration connection 3 forming part of an aspiration duct for a secondary volume flow. The outer housing 1 has an outlet or pressure connection 4 running to the primary circuit, and a pressure connection 5 running to the secondary circuit. In the housing there are two motor-powered blower impellers 6 and 7 forming part of blowing units 8 and 9, which, in addition to the blower impellers, have air guiding housings 10 and 11. These blower impellers are supported by bearings so that they may be turned in the housings. The outer housing is separated into two separate spaces 12 and 13 by way of the wall 14, one of the two blower units being placed in each such space. The two blowers are fixed axially in their spaces, the two blower units being separate from each other and being possibly so designed that they may be powered separately. The axes of turning of the two blower impellers are parallel or nearly parallel to each other or may be in-line with each other. The blower in each case may be radial fan, but, however, in the present case blowers or fans with drum-like impellers are used because of the special design. It is furthermore possible for transverse-flow fans to be used as blower units or, furthermore, fans with two aspiration sides.

As we have seen earlier, there is a distributor unit for the outlet side of the outer housing 1, the distributor unit being able to be adjusted between two different positions so that, with its help, the incoming volume flows at the outlet side of the blower impellers may be switched steplessly or otherwise as desired between the outlet connections. This distributor unit is made up of a housing 15 which is placed downstream from the outer housing and may be best made in a single unit therewith. The distributor housing 15 has two inlets 4*a* and 5*a* joined up with the outlets 4 and 5 of the two blowers 8 and 9, and three outlet connectors 16, 17 and 18, of which one 16 forms part of the primary circuit and a second 17 forms part of the secondary circuit, as will be made clear later in more detail. In the housing 15 there are two adjustable valves in the form of doors 19 and 20 for adjustment of the distribution of the volume flows, the doors 19 and 20 being placed for use with separate outlets of the outer housing.

The said doors 19 and 20 are in the working example of the invention to be seen in the figure in the form of turning doors, that is to say designed for motion about an axis 19*a* and, in the other case, 20*a*, each such axis being at a right angle to the axis of turning of the two blower impellers, that is to say 6*a* and 7*a*. It will be seen that the doors or valves in the structure to be seen in the figure may be moved between two end positions 19*b* and 19*c* in the one case, and 20*b* and 20*c* in the other case, such positions being marked with broken lines, and they may further be moved into a middle position (19, 20) marked in full lines. It will be seen from this that, dependent on the position of adjustment, the volume flow, coming from the blowers, undergoes a distribution to the two outlet connectors: In the positions 19*b* and 20*c* the volume flow is guided by the doors into the outlet connector 17, while the outlet connectors 16 and 18 are shut off. In the end positions 19*c* and 20*b*, on the other hand, the outlet connector 17 is shut off and the full outlet volume flow is guided into connectors 16 and 18. In the middle position a part of the volume flow, coming from the blower outlet 4, makes its way into connector 16 and an other part makes its way into connector 17, while on the other side one part is taken up in connector 18 and an other part is taken up in connector 17. The doors may furthermore be designed as sliding doors or slides, that is to say designed for adjustment at a right angle to the outlet flow direction, somewhat like the slide valves of steam engines. There is no figure of such a system. In the two working examples of the invention, the design may be changed so that the doors are moved in the same direction or in opposite directions to each other, and furthermore the doors or valves may be ganged for adjustment, or as a last possible design, the may be able to be adjusted separately from each other. In all cases adjustment is best made from the outside. It will be clear that such a design of the distributor unit makes the adjustment of the doors very simple so that operation is straightforward and trouble-free and the structure is made as simple as possible.

To give a short overview of the invention, it will be seen that use is made of two normal fans with a separate distributor unit or system on their outlet side, the distributor unit having, on the fan side, connections for the two fans and, on the opposite or plant side, three connections joined up with different circuits. By adjustment of the valve doors in opposite or in the same directions, distribution of the air currents is possible, such flows or currents going to the connectors 16 and 18 and, as a further current, through the connector 17.

An air-conditioning plant having a blower system of the present invention will be seen in FIG. 2. This plant has, in addition to the unit forming part of the invention, that is to say the blower unit 30, which is only to be seen diagrammatically in the figure, a fanless air-conditioning plant 31 which, taking into account the direction of the flow as marked by arrow 32, will be seen to be joined up with the inlet side of the blower unit 30. The air-conditioning plant 31 has an outlet 33, joined up by way of duct 34 with one of the aspiration connections 35 of the outer housing 39 (answering to the aspiration connection 2 for example in FIG. 1). The air-conditioning plant has two inlets 35 and 36 of which inlet 35 is joined with a duct 38 coming from the first outlet connector 37 (answering to connector 16 in FIG. 1), whereas the other inlet 36 is joined up with the outside atmosphere.

Looked at in the direction of flow, it will be seen that the room 40 which is to be air-conditioned is joined up with the outlet side of the outer housing 39 of the blower unit. The three outlet connectors 37, 41 and 42 of the distributor housing of the blower unit 30 (corresponding to the connectors 16, 17, 18 in FIG. 1) are placed side by side in the direction of the shaft of impeller 43, the middle outlet connector 41 corresponding to connector 17 in FIG. 1) is placed so as to be running into the room 40 to be air-conditioned, while the outlet connector 42 of the distributor housing is joined up with the free outside atmosphere. The second outlet or pressure connector of the blower unit 30, that is to say the connector 45 (corresponding to connector 2 in FIG. 1) is joined up with a duct 46 for taking up stale air from the room 40 which is to be air-conditioned. It will be seen that the primary circuit of the unit is in the form of a circuit made up of the outer housing 30 of the blower unit and the air-conditioning plant 31, such circuit furthermore having ducts 34 and 38, whereas the secondary circuit is placed running between the blower unit 30, the room to be air-conditioned and the outside atmosphere and furthermore having ducts 46, 45, 47 and 48. In this way it is in fact possible for the air (used air) coming from the air-conditioned room to be mixed as desired with the air which is to be pumped into the room which is being air-conditioned.

I claim:

1. An air conditioner system comprising a blower unit that includes:

an outer housing defining a first and second chamber;

said outer housing having a first and second inlet and a first and second outlet in communication with the respective first and second chambers;

first and second blowers having impellers and being fixedly mounted in an axial direction in said respective first and second chambers;

a distributor unit having a first and second inlet connected to respective first and second outlets of said outer housing, and having at least first and second outlet connectors;

a gate means in said distributor unit for adjustably controlling flow to said first and second outlets;

an air conditioner having two inlets and an outlet; said outlet of said air conditioner being connected to only the first inlet of said outer housing;

one of said inlets of said air conditioner being connected to only said first outlet connector of said unit;

the other of said inlets of said air conditioner being open to ambient air.

2. An air conditioner system comprising a blower unit that includes:

an outer housing defining a first and second chamber;

said outer housing having a first and second inlet and a first and second outlet in communication with the respective first and second chambers;

first and second blowers having impellers and being fixedly mounted in an axial direction in said respective first and second chambers;

a distributor unit having a first and second inlet connected to respective first and second outlets of said outer housing, and having at least first and second outlet connectors;

a gate means in said distributor unit for adjustably controlling flow to said first and second outlets;

an air conditioner having two inlets and an outlet; said outlet of said air conditioner being connected to the first inlet of said outer housing;

one of said inlets of said air conditioner being connected to said first outlet connector of said unit;

the other of said inlets of said air conditioner being open to ambient air;

said distributor unit having a third outlet connector;

said gate means adjustably directing flow from said first inlet of said distributor unit into said first and third outlet connectors; and said gate means adjustably directing flow from said second inlet of said distributor unit into said second and third outlet connector; and a room to be air conditioned being in communication with said third outlet connector and said second inlet of said distributor unit.

3. An air conditioning system as defined in claim 2 wherein said second outlet connector has an open end to exterior ambient atmosphere.

* * * * *